US009207610B2

(12) United States Patent
Yamasaki et al.

(10) Patent No.: US 9,207,610 B2
(45) Date of Patent: Dec. 8, 2015

(54) CONTROL DEVICE, IMAGE FORMING APPARATUS, NON-TRANSITORY COMPUTER READABLE MEDIUM, AND CONTROL METHOD

(71) Applicant: FUJI XEROX CO., LTD., Minato-ku, Tokyo (JP)

(72) Inventors: Naoya Yamasaki, Kanagawa (JP); Shinichi Tsunoda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/258,451

(22) Filed: Apr. 22, 2014

(65) Prior Publication Data

US 2015/0110515 A1 Apr. 23, 2015

(30) Foreign Application Priority Data

Oct. 18, 2013 (JP) ..... 2013-217222

(51) Int. Cl.
*G03G 15/00* (2006.01)

(52) U.S. Cl.
CPC ..... *G03G 15/5016* (2013.01); *G03G 15/55* (2013.01); *G03G 15/5058* (2013.01)

(58) Field of Classification Search
CPC ..... G03G 15/5016
See application file for complete search history.

(56) References Cited

U.S. PATENT DOCUMENTS 5,461,462 A * 10/1995 Nakane et al. ..... 399/15
6,108,492 A * 8/2000 Miyachi ..... 358/1.15
2003/0044184 A1 3/2003 Yano et al.

FOREIGN PATENT DOCUMENTS

JP 2003-66774 A 3/2003

* cited by examiner

*Primary Examiner* — Sandra Brase
(74) *Attorney, Agent, or Firm* — Sughrue Mion, PLLC

(57) ABSTRACT

Provided is a control device including a reception unit that receives an instruction of an image quality adjustment from a user, a changing unit that changes, when the instruction is received by the reception unit, an image forming condition in an image forming section from a first condition to a second condition, and an output unit that outputs first information indicating the first condition and second information indicating the second condition in association.

8 Claims, 14 Drawing Sheets

FIG. 9

| Y | M | C | K |
|---|---|---|---|
| $Y_{25}$ DENSITY DIFFERENCE | $M_{25}$ DENSITY DIFFERENCE | $C_{25}$ DENSITY DIFFERENCE | $K_{25}$ DENSITY DIFFERENCE |
| $Y_{50}$ DENSITY DIFFERENCE | $M_{50}$ DENSITY DIFFERENCE | $C_{50}$ DENSITY DIFFERENCE | $K_{50}$ DENSITY DIFFERENCE |
| $Y_{75}$ DENSITY DIFFERENCE | $M_{75}$ DENSITY DIFFERENCE | $C_{75}$ DENSITY DIFFERENCE | $K_{75}$ DENSITY DIFFERENCE |
| $Y_{100}$ DENSITY DIFFERENCE | $M_{100}$ DENSITY DIFFERENCE | $C_{100}$ DENSITY DIFFERENCE | $K_{100}$ DENSITY DIFFERENCE |
| PATCH ERROR | PATCH ERROR | PATCH ERROR | PATCH ERROR |
| DENSITY SENSOR ERROR | | | |
| LUT(64) | LUT(64) | LUT(64) | LUT(64) |
| LUT(128) | LUT(128) | LUT(128) | LUT(128) |
| LUT(192) | LUT(192) | LUT(192) | LUT(192) |
| LUT(255) | LUT(255) | LUT(255) | LUT(255) |
| CHARGING OUTPUT | CHARGING OUTPUT | CHARGING OUTPUT | CHARGING OUTPUT |
| EXPOSURE OUTPUT | EXPOSURE OUTPUT | EXPOSURE OUTPUT | EXPOSURE OUTPUT |
| BIAS OUTPUT | BIAS OUTPUT | BIAS OUTPUT | BIAS OUTPUT |
| FILM THICKNESS OF PHOTOCONDUCTOR | FILM THICKNESS OF PHOTOCONDUCTOR | FILM THICKNESS OF PHOTOCONDUCTOR | FILM THICKNESS OF PHOTOCONDUCTOR |
| DETERIORATION OF DEVELOPER | DETERIORATION OF DEVELOPER | DETERIORATION OF DEVELOPER | DETERIORATION OF DEVELOPER |
| DETERIORATION OF TRANSFER MEMBERS | DETERIORATION OF TRANSFER MEMBERS | DETERIORATION OF TRANSFER MEMBERS | DETERIORATION OF TRANSFER MEMBERS |
| DENSITY DIFFERENCE OF TONER DENSITY | DENSITY DIFFERENCE OF TONER DENSITY | DENSITY DIFFERENCE OF TONER DENSITY | DENSITY DIFFERENCE OF TONER DENSITY |
| TONER DENSITY SENSOR ERROR | | | |
| TEMPERATURE AND MOISTURE | | | |
| ENVIRONMENT SENSOR ERROR | | | |

FIG. 10

| Y | M | C | K |
|---|---|---|---|
| $Y_{25}$ DENSITY DIFFERENCE | $M_{25}$ DENSITY DIFFERENCE | $C_{25}$ DENSITY DIFFERENCE | $K_{25}$ DENSITY DIFFERENCE |
| $Y_{50}$ DENSITY DIFFERENCE | $M_{50}$ DENSITY DIFFERENCE | $C_{50}$ DENSITY DIFFERENCE | $K_{50}$ DENSITY DIFFERENCE |
| $Y_{75}$ DENSITY DIFFERENCE | $M_{75}$ DENSITY DIFFERENCE | $C_{75}$ DENSITY DIFFERENCE | $K_{75}$ DENSITY DIFFERENCE |
| $Y_{100}$ DENSITY DIFFERENCE | $M_{100}$ DENSITY DIFFERENCE | $C_{100}$ DENSITY DIFFERENCE | $K_{100}$ DENSITY DIFFERENCE |
| PATCH ERROR | PATCH ERROR | PATCH ERROR | PATCH ERROR |
| DENSITY SENSOR ERROR | | | |
| CHARGING OUTPUT | CHARGING OUTPUT | CHARGING OUTPUT | CHARGING OUTPUT |
| EXPOSURE OUTPUT | EXPOSURE OUTPUT | EXPOSURE OUTPUT | EXPOSURE OUTPUT |
| BIAS OUTPUT | BIAS OUTPUT | BIAS OUTPUT | BIAS OUTPUT |

FIG. 13

| Y | M | C | K |
|---|---|---|---|
| $Y_{25}$ DENSITY DIFFERENCE | $M_{25}$ DENSITY DIFFERENCE | $C_{25}$ DENSITY DIFFERENCE | $K_{25}$ DENSITY DIFFERENCE |
| $Y_{50}$ DENSITY DIFFERENCE | $M_{50}$ DENSITY DIFFERENCE | $C_{50}$ DENSITY DIFFERENCE | $K_{50}$ DENSITY DIFFERENCE |
| $Y_{75}$ DENSITY DIFFERENCE | $M_{75}$ DENSITY DIFFERENCE | $C_{75}$ DENSITY DIFFERENCE | $K_{75}$ DENSITY DIFFERENCE |
| $Y_{100}$ DENSITY DIFFERENCE | $M_{100}$ DENSITY DIFFERENCE | $C_{100}$ DENSITY DIFFERENCE | $K_{100}$ DENSITY DIFFERENCE |
| PATCH ERROR | PATCH ERROR | PATCH ERROR | PATCH ERROR |
| DENSITY SENSOR ERROR | | | |
| LUT(64) | LUT(64) | LUT(64) | LUT(64) |
| LUT(128) | LUT(128) | LUT(128) | LUT(128) |
| LUT(192) | LUT(192) | LUT(192) | LUT(192) |
| LUT(255) | LUT(255) | LUT(255) | LUT(255) |
| CHART DENSITY DIFFERENCE (1) | CHART DENSITY DIFFERENCE (1) | CHART DENSITY DIFFERENCE (1) | CHART DENSITY DIFFERENCE (1) |
| CHART DENSITY DIFFERENCE (2) | CHART DENSITY DIFFERENCE (2) | CHART DENSITY DIFFERENCE (2) | CHART DENSITY DIFFERENCE (2) |
| CHART DENSITY DIFFERENCE (3) | CHART DENSITY DIFFERENCE (3) | CHART DENSITY DIFFERENCE (3) | CHART DENSITY DIFFERENCE (3) |
| ⋮ | ⋮ | ⋮ | ⋮ |
| CHART DENSITY DIFFERENCE (23) | CHART DENSITY DIFFERENCE (23) | CHART DENSITY DIFFERENCE (23) | CHART DENSITY DIFFERENCE (23) |
| CHART DENSITY DIFFERENCE (24) | CHART DENSITY DIFFERENCE (24) | CHART DENSITY DIFFERENCE (24) | CHART DENSITY DIFFERENCE (24) |
| LUT(0) | LUT(0) | LUT(0) | LUT(0) |
| LUT(8) | LUT(8) | LUT(8) | LUT(8) |
| LUT(16) | LUT(16) | LUT(16) | LUT(16) |
| ⋮ | ⋮ | ⋮ | ⋮ |
| LUT(248) | LUT(248) | LUT(248) | LUT(248) |
| LUT(255) | LUT(255) | LUT(255) | LUT(255) |
| CHARGING OUTPUT | CHARGING OUTPUT | CHARGING OUTPUT | CHARGING OUTPUT |
| EXPOSURE OUTPUT | EXPOSURE OUTPUT | EXPOSURE OUTPUT | EXPOSURE OUTPUT |
| BIAS OUTPUT | BIAS OUTPUT | BIAS OUTPUT | BIAS OUTPUT |
| FILM THICKNESS OF PHOTOCONDUCTOR | FILM THICKNESS OF PHOTOCONDUCTOR | FILM THICKNESS OF PHOTOCONDUCTOR | FILM THICKNESS OF PHOTOCONDUCTOR |
| DETERIORATION OF DEVELOPER | DETERIORATION OF DEVELOPER | DETERIORATION OF DEVELOPER | DETERIORATION OF DEVELOPER |
| DETERIORATION OF TRANSFER MEMBERS | DETERIORATION OF TRANSFER MEMBERS | DETERIORATION OF TRANSFER MEMBERS | DETERIORATION OF TRANSFER MEMBERS |
| DENSITY DIFFERENCE OF TONER DENSITY | DENSITY DIFFERENCE OF TONER DENSITY | DENSITY DIFFERENCE OF TONER DENSITY | DENSITY DIFFERENCE OF TONER DENSITY |
| TONER DENSITY SENSOR ERROR | | | |
| TEMPERATURE AND MOISTURE | | | |
| ENVIRONMENT SENSOR ERROR | | | |

FIG. 14

DENSITY ADJUSTMENT

| | LOW DENSITY | MEDIUM DENSITY | HIGH DENSITY |
|---|---|---|---|
| YELLOW | 0 | +1 | 0 |
| MAGENTA | −1 | −1 | −1 |
| CYAN | −1 | 0 | −1 |
| BLACK | 0 | 0 | 0 |

FIG. 15

| Y | M | C | K |
|---|---|---|---|
| LUT BEFORE ADJUSTMENT | LUT BEFORE ADJUSTMENT | LUT BEFORE ADJUSTMENT | LUT BEFORE ADJUSTMENT |
| LOW DENSITY ADJUSTMENT VALUE | LOW DENSITY ADJUSTMENT VALUE | LOW DENSITY ADJUSTMENT VALUE | LOW DENSITY ADJUSTMENT VALUE |
| MEDIUM DENSITY ADJUSTMENT VALUE | MEDIUM DENSITY ADJUSTMENT VALUE | MEDIUM DENSITY ADJUSTMENT VALUE | MEDIUM DENSITY ADJUSTMENT VALUE |
| HIGH DENSITY ADJUSTMENT VALUE | HIGH DENSITY ADJUSTMENT VALUE | HIGH DENSITY ADJUSTMENT VALUE | HIGH DENSITY ADJUSTMENT VALUE |
| CHARGING OUTPUT | CHARGING OUTPUT | CHARGING OUTPUT | CHARGING OUTPUT |
| EXPOSURE OUTPUT | EXPOSURE OUTPUT | EXPOSURE OUTPUT | EXPOSURE OUTPUT |
| BIAS OUTPUT | BIAS OUTPUT | BIAS OUTPUT | BIAS OUTPUT |
| FILM THICKNESS OF PHOTOCONDUCTOR | FILM THICKNESS OF PHOTOCONDUCTOR | FILM THICKNESS OF PHOTOCONDUCTOR | FILM THICKNESS OF PHOTOCONDUCTOR |
| DETERIORATION OF DEVELOPER | DETERIORATION OF DEVELOPER | DETERIORATION OF DEVELOPER | DETERIORATION OF DEVELOPER |
| DETERIORATION OF TRANSFER MEMBERS | DETERIORATION OF TRANSFER MEMBERS | DETERIORATION OF TRANSFER MEMBERS | DETERIORATION OF TRANSFER MEMBERS |
| DENSITY DIFFERENCE OF TONER DENSITY | DENSITY DIFFERENCE OF TONER DENSITY | DENSITY DIFFERENCE OF TONER DENSITY | DENSITY DIFFERENCE OF TONER DENSITY |
| TONER DENSITY SENSOR ERROR | | | |
| TEMPERATURE AND MOISTURE | | | |
| ENVIRONMENT SENSOR ERROR | | | |

CONTROL DEVICE, IMAGE FORMING APPARATUS, NON-TRANSITORY COMPUTER READABLE MEDIUM, AND CONTROL METHOD

CROSS-REFERENCE TO RELATED APPLICATIONS

This application is based on and claims priority under 35 USC 119 from Japanese Patent Application No. 2013-217222 filed Oct. 18, 2013.

BACKGROUND

Technical Field

The present invention relates to a control device, an image forming apparatus, a non-transitory computer readable medium, and a control method.

SUMMARY

According to an aspect of the invention, there is provided a control device including:

a reception unit that receives an instruction of an image quality adjustment from a user;

a changing unit that changes, when the instruction is received by the reception unit, an image forming condition in an image forming section from a first condition to a second condition; and an output unit that outputs first information indicating the first condition and second information indicating the second condition in association.

BRIEF DESCRIPTION OF THE DRAWINGS

Exemplary embodiments of the present invention will be described in detail based on the following figures, wherein:

FIG. 9 is a diagram illustrating storage information stored by a simple gradation correction;

FIG. 10 is a diagram illustrating information displayed in a UI section;

FIG. 13 is a diagram illustrating storage information stored by a gradation correction;

FIG. 14 is a diagram illustrating a screen displayed in a UI section in a density adjustment; and FIG. 15 is a diagram illustrating storage information stored by a density adjustment.

DETAILED DESCRIPTION

Examples

Figure 1:
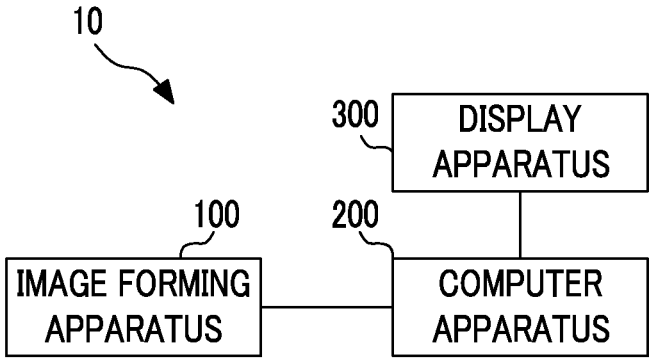
FIG. 1 is a block diagram illustrating an entire configuration of an image forming system.

FIG. 1 is a block diagram illustrating an entire configuration of an image forming system 10 according to an example of the present invention. The image forming system 10 includes an image forming apparatus 100 and a computer apparatus 200. The image forming apparatus 100 and the computer apparatus 200 are connected to each other through a wired or wireless communication path. Further, the computer apparatus 200 is connected to a display apparatus 300. Although not shown herein, the image forming system 10 may have a configuration in which the plural computer apparatuses 200 may be connected to one image forming apparatus 100, or may have a configuration in which the plural image forming apparatuses 100 may be connected to one computer apparatus 200. Further, the image forming apparatus 100 and the computer apparatus 200 may not be constantly connected to each other.

The image forming apparatus 100 is an apparatus (printer) that forms an image on a recording medium. Here, the recording medium is a sheet in this example, but is not limited to the sheet. Further, it is assumed that a recording type of the image forming apparatus 100 is an electro-photographic type. That is, the image forming apparatus 100 forms a toner image on the sheet through processes of charging, exposure, development, transfer and fixing.

The computer apparatus 200 is an apparatus that performs communication with the image forming apparatus 100 to transmit and receive data. The computer apparatus 200 is a server apparatus or a personal computer that manages the plural image forming apparatuses 100, for example. The computer apparatus 200 may be directly connected to the image forming apparatus 100 through a communication cable, or may be remotely connected to the image forming apparatus 100 through a network such as the Internet. The computer apparatus 200 is used by a person (for example, a serviceman or a manager that performs maintenance of the image forming apparatus 100) different from a user of the image forming apparatus 100.

The display apparatus 300 is an apparatus that displays information. The display apparatus 300 displays information according to data received by the computer apparatus 200. The display apparatus 300 may be formed integrally with the computer apparatus 200. As an example in which the computer apparatus 200 and the display apparatus 300 are integrally formed, a notebook personal computer or a tablet terminal may be used.

Figure 2:
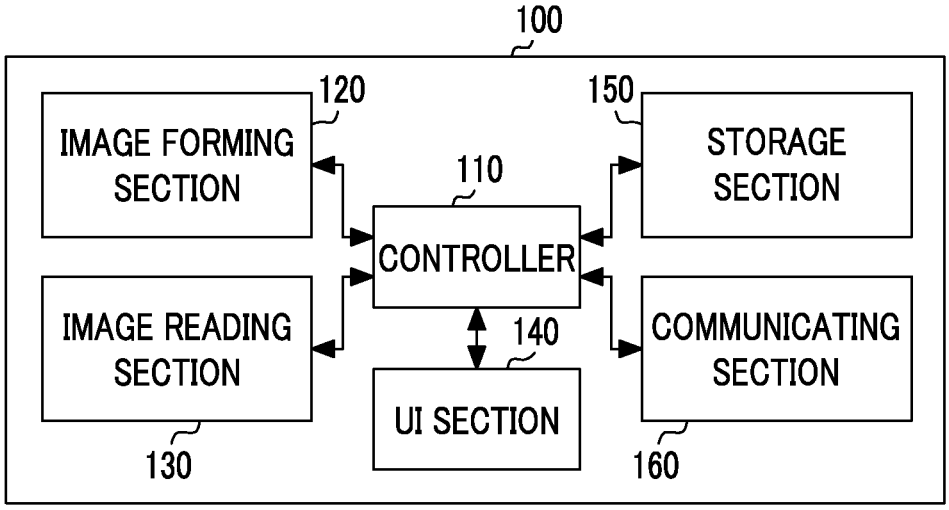
FIG. 2 is a block diagram illustrating a hardware configuration of an image forming apparatus.

FIG. 2 is a block diagram illustrating a hardware configuration of the image forming apparatus 100. The image forming apparatus 100 includes a controller 110, an image forming section 120, an image reading section 130, a user interface (UI) section 140, a storage section 150, and a communicating section 160.

The controller 110 is a section that controls operations of the respective components of the image forming apparatus 100. The controller 110 includes an arithmetic processing unit such as a central processing unit (CPU) and a memory that corresponds to a main memory, and executes a program to perform a control relating to image formation. The controller 110 corresponds to an example of a control device according to the exemplary embodiment of the invention.

The image forming section 120 is a section that forms an image on a sheet. The image forming section 120 forms an image based on image data on a sheet according to an instruction of a user. Here, the image data may be supplied from the outside through a communication path, or may be generated by the image reading section 130. Further, in the present embodiment, the image forming section 120 forms toner images of yellow (Y), magenta (M), cyan (C) and black (K), and transfers the toner images onto a sheet in an overlapping manner, to thereby form a color image. The image forming section 120 corresponds to an example of an image forming section according to the present embodiments.

The image reading section 130 is a section that reads an image and generates image data based on the read image. The image reading section 130 includes an image sensor that is formed by an imaging element such as a charge coupled device (CCD), and an image processing circuit that generates image data based on an output value of the image sensor.

The UI section 140 is a section that communicates information with a user. The UI section 140 includes a part that receives information from the user, and a part that provides information to the user. Specifically, the UI section 140 includes buttons (keys) as the part that receives the information from the user, and includes a display device such as a liquid crystal display or a speaker as the part that provides the information to the user. In the present example, it is assumed that the UI section 140 includes at least a touch screen.

The storage section 150 is a section that stores data, and corresponds to an auxiliary memory. The storage section 150 includes a recording medium such as a hard disk or a flash memory, and stores data used in image formation in advance or stores data generated and output by the controller 110.

Further, the storage section 150 may include an interface with respect to a removable medium, that is, a detachable recording medium to store data in the removable medium or to read data from the removable medium. As the removable medium, a so-called universal serial bus (USB) memory (also referred to as a USB flash drive), a memory card, an optical disc or the like may be used.

The communicating section 160 is a section that transmits and receives data through a communication path. The communicating section 160 includes a communication interface for communication with an external apparatus such as the computer apparatus 200. For example, when the communication is performed through a network, the communicating section 160 includes a network interface card (NIC) or a modem. Further, when the external apparatus is connected thereto in a wired manner through a USB cable, the communicating section 160 includes a USB port.

Figure 3:
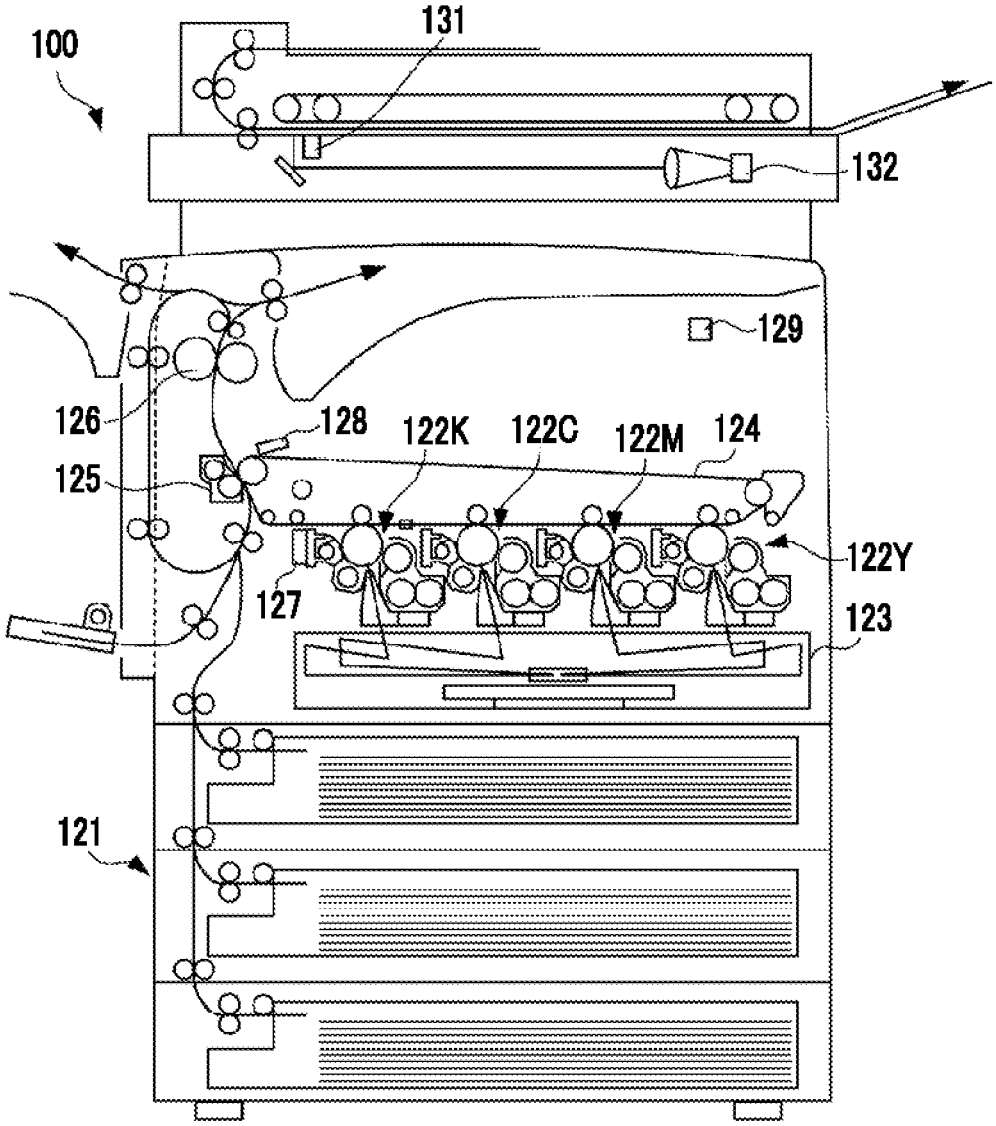
FIG. 3 is a diagram illustrating a configuration of an image forming apparatus.

FIG. 3 is a diagram illustrating a configuration (particularly, the image forming section 120 and the image reading section 130) of the image forming apparatus 100. The image forming section 120 includes a sheet supply unit 121, development units 122Y, 122M, 122C and 122K, an exposure unit 123, an intermediate image transfer belt 124, a secondary image transfer roller 125, a fixing unit 126, a density sensor 127, a cleaning member 128, and an environment sensor 129. Further, the image reading section 130 includes a light source 131 and an image sensor 132.

The sheet supply unit 121 accommodates a sheet before image formation, and supplies the sheet as necessary. The sheet supply unit 121 may accommodate plural types of sheets of different sizes or sheet types.

The development units 122Y, 122M, 122C and 122K form toner images and transfer the toner images onto the intermediate image transfer belt 124. Each of the development units 122Y, 122M, 122C and 122K includes a photoconductor, a charging part that charges the photoconductor, a developing part that supplies toner to the photoconductor, and a primary image transfer roller that transfers the toner onto the intermediate image transfer belt 124 to form each toner image of yellow (Y), magenta (M), cyan (C) and black (K). In the developing part, a toner density sensor that measures a toner density (mixture ratio of the toner and a carrier) is provided.

The exposure unit 123 exposes the charged photoconductor of the development units 122Y, 122M, 122C and 122K to form an electrostatic latent image according to light for irradiation on each photoconductor. The intermediate image transfer belt 124 is an endless belt member that rotates and transports the toner image formed according to the electrostatic latent image on the photoconductor. The secondary image transfer roller 125 faces the intermediate image transfer belt 124 at a predetermined position (secondary image transfer position), and transfers the toner image onto a sheet supplied from the sheet supply unit 121 at the position. The fixing unit 126 applies heat and pressure to the sheet on which the toner image is transferred to fix the toner onto the sheet.

The density sensor 127 is a sensor that measures the density of the toner image formed on the intermediate image transfer belt 124. Here, the density refers to an optical density and a color density. In the present example, the density sensor 127 irradiates the toner image with light and measures a coverage per unit area of the toner image based on the intensity of the reflected light. The density sensor 127 is an example of a detecting section.

The cleaning member 128 is a member that is provided in the vicinity of the intermediate image transfer belt 124 and removes toner which is not transferred onto the sheet. The cleaning member 128 is used to remove a toner image for a simple gradation correction to be described later from the intermediate image transfer belt 124, for example.

The environment sensor 129 is a sensor that measures an environment in image formation. Here, the environment includes temperature, moisture, atmospheric pressure or the like. In the present example, it is assumed that the environment sensor 129 is a sensor that measures the temperature and the moisture.

The light source 131 emits light to an original document that contains an image that is a reading object. The light source 131 may employ a fluorescent tube lamp or a light emitting diode (LED) as a light source. The image sensor 132 receives light reflected from the original document among the light emitted from the light source 131, and outputs an electric signal according to the received light.

The image forming apparatus 100 has the above-described configuration. With this configuration, the image forming apparatus 100 forms an image according to an operation of a user. Further, the image forming apparatus 100 executes an image quality adjustment in a manual or automatic manner. Here, the manual image quality adjustment refers to an image quality adjustment executed at a timing instructed by the user. On the other hand, the automatic image quality adjustment refers to an image quality adjustment executed at a timing regardless of the instruction of the user (that is, at a timing determined by the image forming apparatus 100). In the present example, the manual image quality adjustment includes three types of image quality adjustments of "simple gradation correction", "gradation correction" and "density adjustment", to be described later.

The image forming apparatus 100 executes the image quality adjustment by changing an image forming condition. Here, the image forming condition includes various conditions in image formation, which include at least parameters relating to the image quality, set in the image forming apparatus 100. That is, the image forming condition represents information indicating a condition under which the image is formed in the image forming apparatus 100.

Further, when executing the manual image quality adjustment, the image forming apparatus 100 outputs the image forming condition before and after the adjustment in association. Here, the output includes at least the supply of information to be recorded in an external apparatus, and may include visualization of the information so that a serviceman may visually recognize the information. Further, here, the external apparatus may include a removable medium as well as the computer apparatus 200.

Figure 4:
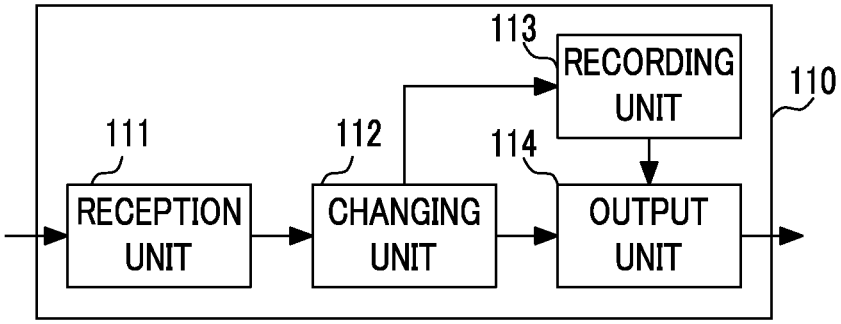
FIG. 4 is a functional block diagram illustrating a functional configuration of an image forming apparatus.

FIG. 4 is a functional block diagram illustrating a functional configuration relating to the output of the image forming condition. The controller 110 realizes a reception unit 111, a changing unit 112, a recording unit 113 and an output unit 114 when the image forming condition is output. These units may be realized in the form of software as the controller 110 executes a program.

The reception unit 111 is a unit that receives an instruction of a user. The instruction received by the reception unit 111 includes at least an instruction for instructing the image forming apparatus 100 to execute the manual image quality adjustment (hereinafter, referred to as a "manual adjustment instruction"). The reception unit 111 acquires information indicating an operation of the user from the UI section 140, and determines for reception the instruction of the user based on the information.

The changing unit 112 is a unit that changes the image forming condition. In other words, the changing unit 112 is a unit that causes the image forming section 120 to change the image forming condition and controls the image forming section 120 to form an image according to the changed image forming condition. When the manual adjustment instruction is received by the reception unit 111, the changing unit 112 changes the image forming condition according to the instruction. A specific method of changing the image forming condition is different according to the type of the manual image quality adjustment. Hereinafter, the image forming condition before being changed by the changing unit 112 is referred to as a "first condition", and the image forming condition after being changed by the changing unit 112 is referred to as a "second condition". That is, the changing unit 112 changes the image forming condition from the first condition to the second condition.

The recording unit 113 is a unit that records the image forming condition. Specifically, the recording unit 113 records first information indicating the first condition and second information indicating the second condition. Further, the recording unit 113 records the first information and the second information in association. For example, the recording unit 113 may associate the first information with the second information by recording the first information and the second information in a single file. Here, a specific method for the association is not particularly limited as long as one of the first information and the second information may be referenced based on the other one thereof. The recording unit 113 records the first information and the second information in the storage section 150.

The output unit 114 is a unit that outputs the image forming condition. The output unit 114 outputs the first information and the second information in association. In the present embodiment, the output unit 114 records the first information and the second information in a removable medium, or transmits the first information and the second information to the computer apparatus 200 through the communicating section 160. Further, the output unit 114 may visualize the first information and the second information in the UI section 140 or the image forming section 120.

The first information and the second information are not necessarily recorded by the recording unit 113. For example, in a case where the output unit 114 transmits the first information and the second information to the computer apparatus 200, when the image forming apparatus 100 and the computer apparatus 200 are constantly connected to each other, the output unit 114 may output the first information and the second information every time when the image forming condition is changed. On the other hand, in this case, when the image forming apparatus 100 and the computer apparatus 200 are not constantly connected to each other, the recording unit 113 may temporarily record the first information and the second information every time when the image forming condition is changed by the instruction of the manual image quality adjustment, and the output unit 114 may read for output the first information and the second information from the storage section 150 at a timing when the image forming apparatus 100 and the computer apparatus 200 are connected to each other. For example, when a serviceman connects the computer apparatus 200 of his own to the image forming apparatus 100 installed at a visit place, the output unit 114 may output the first information and the second information corresponding to plural times of changes to the computer apparatus 200. Even when the manual image quality adjustment is performed plural times until the computer apparatus 200 is connected, it is possible to recognize, at a point of time when the computer apparatus 200 is connected, the image forming condition before and after being changed for each change in addition to the times of changes of the image forming condition based on the instruction of the manual image quality adjustment up to then, through the computer apparatus 200.

Alternatively, the recording unit 113 may record the first information and the second information until the computer apparatus 200 requests transmission of the first information and the second information, and the output unit 114 may output the first information and the second information after the computer apparatus 200 requests the transmission of the first information and the second information. Further, the output unit 114 may output the first information and the second information at a predetermined timing, for example, once a day, every several hours, or the like. That is, even when the image forming apparatus 100 and the computer apparatus 200 are constantly connected to each other, the recording unit 113 may temporarily record the first information and the second information every time when the image forming condition is changed according to the instruction of the manual image quality adjustment, and the output unit 114 may transmit the first information and the second information corresponding to plural times of changes to the computer apparatus 200 at a predetermined timing, for example, immediately before an operation mode of the image forming apparatus 100 is changed to a sleep mode, or immediately after electric power is supplied.

In the present example, when the image forming condition is changed according to the manual image quality adjustment, the image forming apparatus 100 operates as follows.

Figure 5:
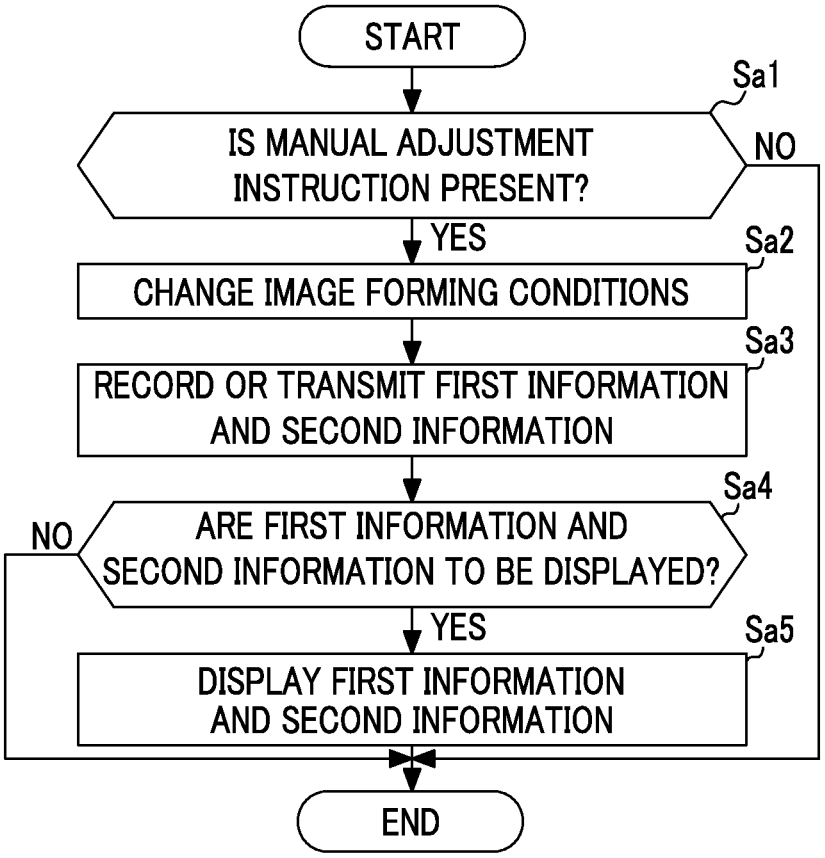
FIG. 5 is a flowchart illustrating an outline of a process executed in a manual image quality adjustment.

FIG. 5 is a flowchart illustrating an outline of processes executed in the manual image quality adjustment. The processes shown in FIG. 5 represent the flow of processes that are common to all the three types of manual image quality adjustments. Here, details of a process in each step may be different according to the type of the manual image quality adjustment. First, the image forming apparatus 100 determines whether the manual adjustment instruction is performed by a user (step Sa1). When the manual adjustment instruction is received, the image forming apparatus 100 executes the subsequent process.

When the manual adjustment instruction is received, the image forming apparatus 100 executes the image quality adjustment according to the instruction of the user, and changes the image forming condition (step Sa2). Then, the image forming apparatus 100 records the first information and the second information indicating the image forming condition before and after being changed, or transmits the first information and the second information to the computer apparatus 200 (step Sa3). In step Sa3, which one of the recording and transmission of the first information and the second information is performed is determined in advance according to user's setting or the like.

After these processes are finished, the image forming apparatus 100 determines whether to display information in the UI section 140 (step Sa4). For example, when the image forming condition is changed according to the manual image quality adjustment, the user sets in advance whether to display the information (that is, the first information and the second information) indicating the image forming condition before and after being changed. When it is necessary to display the information in the UI section 140, the image forming apparatus 100 displays some or all of the first information and the second information in the UI section 140 according to the process executed in step Sa2 (step Sa5).

Here, the process of step Sa4 or Sa5 may not be performed. For example, the image forming apparatus 100 may constantly display the information in the UI section 140 without executing the determination of step Sa4. Further, the image forming apparatus 100 may not display the information in the UI section 140 after the change of the image forming condition.

Figure 6:
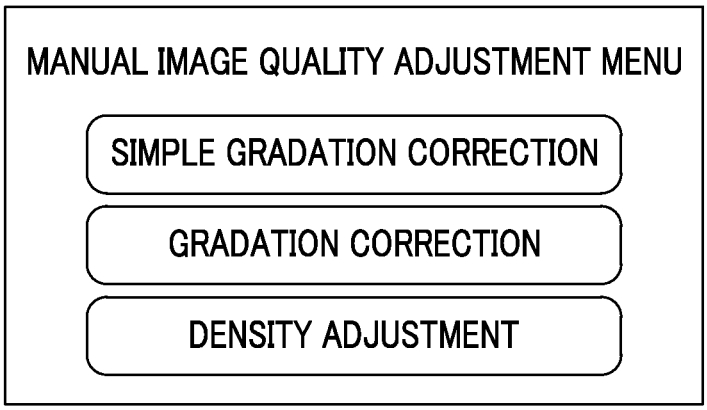
FIG. 6 is a diagram illustrating an example of a screen displayed in a UI section.

FIG. 6 is a diagram illustrating an example of a screen displayed in a touch screen of the UI section 140. When executing the manual image quality adjustment, the user of the image forming apparatus 100 performs a predetermined operation to display a screen. The image forming apparatus 100 displays buttons that respectively correspond to "simple gradation correction", "gradation correction" and "density adjustment" in the UI section 140. Then, the image forming apparatus 100 executes the image quality adjustment according to a selected button. The operation for selecting any one of the buttons corresponds to the above-described manual adjustment instruction. The buttons may not be displayed in the same screen, but may be displayed in different screens.

In the simple gradation correction, plural toner images having different densities are formed onto the intermediate image transfer belt 124, and the image forming condition is changed based on the formed toner images to correct the gradation. Specifically, in the simple gradation correction, a toner image formed on the intermediate image transfer belt 124 to have a predetermined density (that is, object density) is read by the density sensor 127, and the image forming condition is changed based on a density difference between the actually measured density and the object density.

On the other hand, in the gradation correction, an image is formed on a sheet, and the image forming condition is changed based on the formed image to correct the gradation. Specifically, in the gradation correction, a predetermined image (for example, a color chart for correction) formed on the sheet is read by the image reading section 130, and the image forming condition is changed based on a density difference between the image and the read result. In the gradation correction, in order to further enhance a color reproduction characteristic of the image formed on the sheet, the simple gradation correction may be executed before the image is formed on the sheet.

Further, in the density adjustment, an image (toner image) is not formed as in the simple gradation correction and the gradation correction, but instead, the density of the image is changed according to an operation of a user. When the user feels that the image is formed thick, the user adjusts the density so that the image to be formed becomes thin. Contrarily, when the user feels that the image is formed thin, the user adjusts the density so that the image to be formed becomes thick. In the density adjustment, the entire density of the image may become thick (or thin). Alternatively, the density of the image may be divided into plural density regions (a low density region, a medium density region and a high density region), and the density may be changed for each density region.

Figure 7:
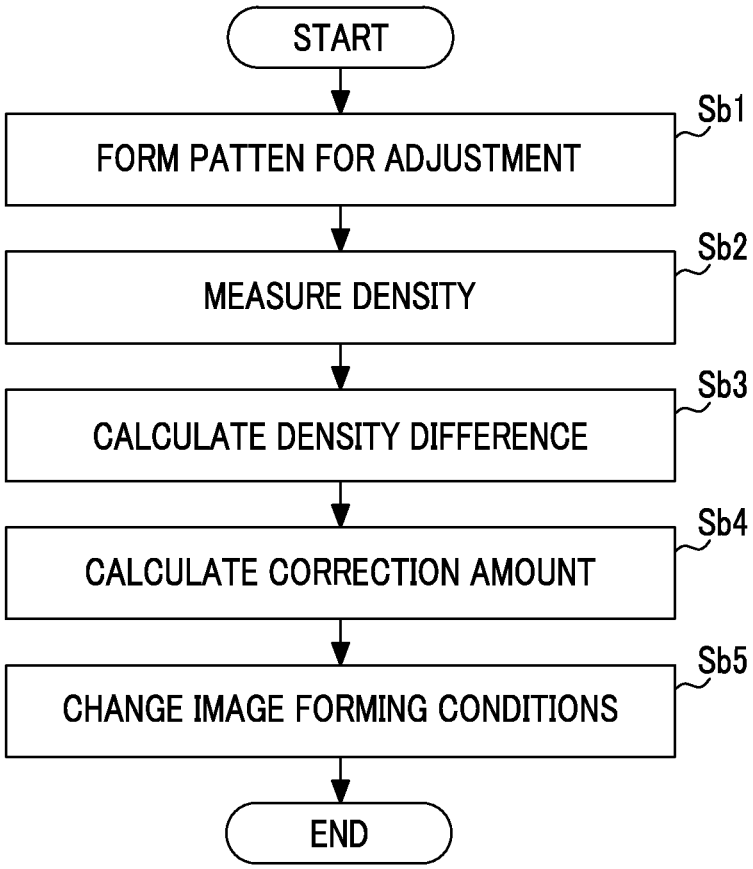
FIG. 7 is a flowchart illustrating a simple gradation correction.

FIG. 7 is a flowchart illustrating a specific process of the simple gradation correction. In the simple gradation correction, the image forming apparatus 100 forms a toner image having a predetermined pattern onto the intermediate image transfer belt 124 (step Sb1). Hereinafter, the pattern of this toner image is referred to as a "pattern for adjustment".

Figure 8:
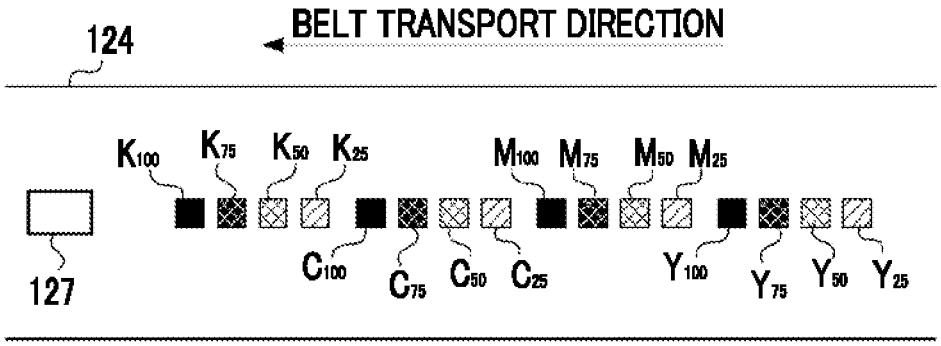
FIG. 8 is a diagram illustrating an example of a pattern for adjustment.

FIG. 8 is a diagram illustrating an example of the pattern for adjustment. The pattern for adjustment shown in FIG. 8 is arranged so that patches $K_{100}$, $K_{75}$, $K_{50}$, $K_{25}$, $C_{100}$, $C_{75}$, $C_{50}$, $C_{25}$, $M_{100}$, $M_{75}$, $M_{50}$, $M_{25}$, $Y_{100}$, $Y_{75}$, $Y_{50}$ and $Y_{25}$ that are toner images of predetermined densities are read in a predetermined order by the density sensor 127. Here, a sign of each patch corresponds to the color of the toner image, and a subscript thereof corresponds to the density (of which the unit is %) of the toner image. For example, the patch $K_{100}$ represents a toner image covered by a black toner at a coverage of 100%. When a gradation number of each color is 256 (that is, 8 bits), the patch $K_{100}$ represents a toner image in which "255", that is, the maximum value is set as an input value.

The pattern for adjustment has only to be formed on the intermediate image transfer belt 124, and does not have to be transferred onto a sheet. The pattern for adjustment is removed from the intermediate image transfer belt 124 by the cleaning member 128.

The image forming apparatus 100 reads the pattern for adjustment formed on the intermediate image transfer belt 124 using the density sensor 127 to measure the density of each patch (step Sb2). Further, the image forming apparatus 100 calculates the density difference between the measured density and the object density (step Sb3), and calculates a correction amount of the image forming condition based on the density difference (step Sb4). Then, the image forming apparatus 100 changes the image forming condition based on the calculated correction amount (step Sb5). For example, the image forming apparatus 100 calculates the correction amount of any one of an output value in charging (charging output), an output value in exposure (exposure output) and a bias electric potential in development (bias output) to change the image forming condition. Alternatively, the image forming apparatus 100 may correct values of a look up table that is applied to gradation values of image data to change the image forming condition. That is, all the charging output, the exposure output, the bias output and the values of the look up table correspond to an example of the image forming condition in the present example.

FIG. 9 is a diagram illustrating storage information stored by the simple gradation correction. Here, the storage includes storage in the own apparatus and storage in an external apparatus. The storage information shown in FIG. 9 is recorded or transmitted as a single data file, for example. Further, the image forming apparatus 100 records or transmits the storage information every time when the image forming condition is changed by the instruction of the manual image quality adjustment. After being transmitted to the external apparatus, the storage information is displayed in a display apparatus (for example, the display apparatus 300) for the external apparatus to enter a state capable of being recognized by a serviceman or a manager. The image forming apparatus 100 may record the storage information every time when the image forming condition is changed to be accumulated in a time-series manner without deletion of the old storage information.

The storage information is data including the density difference of each patch, error information on the patches or the density sensor 127, the values of the look up table (LUT), the charging output, the exposure output, the bias output, the film thickness of the photoconductor, deterioration of the developer, deterioration of the transfer members, the density difference of the toner density, error information on the toner density sensor, temperature and moisture, error information on the environment sensor 129, and the like.

The density difference of each patch is stored for each color and each density. This information represents information indicating the difference between the density of the patch formed based on the image forming condition before being changed and the object density, and may thus correspond to an example of the information indicating the image forming condition before being changed, that is, the first information.

The error information on the patch represents information indicating that the patch is not appropriately formed. For example, when the patch is not formed, or when an abnormal patch of which the density difference exceeds a predetermined threshold value is formed, information indicating that an error occurs in formation of the patch is stored. On the other hand, the error information on the density sensor 127 represents information indicating that the patch is appropriately formed but the reading of the patch is not appropriately performed.

As the charging output, the exposure output, the bias output and the values of the look up table, values corrected by the simple gradation correction are respectively stored. These types of information may correspond to an example of the information indicating the image forming condition after being changed, that is, the second information.

Here, as the values of the look up table, respective values corresponding to the corresponding input values of the densities of the respective patches, that is, 64 (25%), 128 (50%), 192 (75%), 255 (100%) are stored. As the values of the look up table, values corresponding to the respective input values of 256 gradations may be respectively stored, but from the viewpoint of the data amount of the storage information, it is preferable that values capable of specifying a characteristic (inclination) of the look up table be stored.

The film thickness of the photoconductor, the deterioration of the developer and the deterioration of the transfer members respectively represents information indicating the degree of use of consumables when the manual adjustment instruction is received. For example, the film thickness of the photoconductor decreases according to use, so that the charging performance deteriorates. These types of information may be represented by a use starting date and time of the corresponding consumables and an elapse time from the date and time.

The density difference of the toner density represents information indicating the difference between the toner density when the manual adjustment instruction is received and the object density. Further, the error information on the toner density sensor represents information indicating that an error occurs, for example, when the toner density is not measured or when an abnormal value is measured as the toner density.

The temperature and the moisture represent information indicating temperature and moisture measured by the environment sensor 129 when the manual adjustment instruction is received. Further, the error information on the environment sensor 129 represents information indicating that an error occurs, for example, when the temperature and the moisture are not measured or when abnormal values are measured as the temperature and the moisture.

The storage information is not limited to the shown information, and for example, may include information such as an image forming speed (process speed), a sheet type (a plain paper, a thick sheet or the like) or an image forming mode (text mode, photograph mode, high resolution mode or the like).

FIG. 10 is a diagram illustrating an example of information displayed in the UI section 140. In the present example, the image forming apparatus 100 displays a part of the storage information in the UI section 140. The storage information displayed in the UI section 140 is not limited to the example shown in FIG. 10, and may be different storage information or may be a part of the storage information shown in FIG. 10.

Further, the image forming apparatus 100 may also form the pattern for adjustment after the image forming condition is changed as well as before the image forming condition is changed, may read the formed pattern for adjustment, and may record or transmit the density differences before and after the change of the image forming condition in association or may display the density differences in the UI section 140. The user confirms the density differences before and after the change of the image forming condition to confirm how much the image quality is changed (improved) by the simple gradation correction. In this case, the density difference after the change of the image forming condition corresponds to an example of the second information according to the exemplary embodiment of the invention. With respect to the values of the look up table, the charging output, the exposure output, the bias output and the like, similarly to the density difference, the image forming apparatus 100 may record or transmit the values before and after the change of the image forming condition in association.

Figure 11:
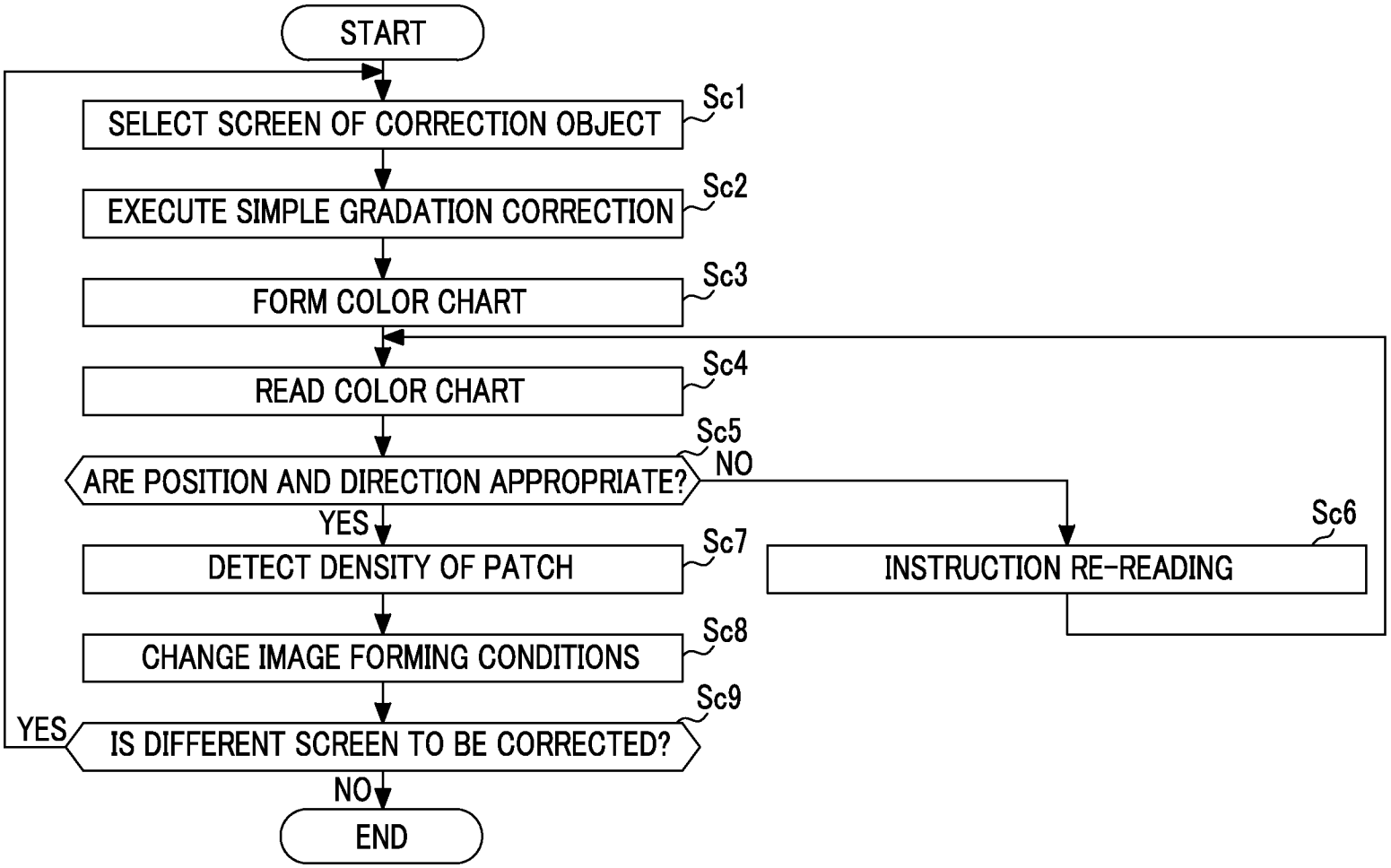
FIG. 11 is a flowchart illustrating a gradation correction.

FIG. 11 is a flowchart illustrating a specific process of the gradation correction. Here, the gradation correction is a process executed for each screen (dot screen). The respective screens have different dot shapes or different screen angles. Further, the screen may be divided into a copy screen and a printing screen.

In the gradation correction, the image forming apparatus 100 selects a screen that is a correction object (step Sc1). For example, the image forming apparatus 100 asks a user which screen is to be selected as the correction object through the UI section 140, and receives the selection of the user. Alternatively, the image forming apparatus 100 may collectively perform the gradation correction for all the screens. In this case, the image forming apparatus 100 selects the respective screens in a predetermined order.

After selecting the screen that is the correction object, the image forming apparatus 100 executes the simple gradation correction using the selected screen (step Sc2). The process of step Sc2 is executed in the order of the flowchart shown in FIG. 7. That is, in the gradation correction, the image forming apparatus 100 changes the image forming condition before the color chart for correction is formed on a sheet to adjust the image quality.

After changing the image forming condition by the simple gradation correction, the image forming apparatus 100 forms the color chart for correction on the sheet (step Sc3). Here, the image forming apparatus 100 displays a message in the UI section 140 or outputs an alarm to request the user to cause the image reading section 130 to read the color chart for correction. When the user is prepared for the reading of the color chart for correction, the user performs an operation therefor.

Figure 12:
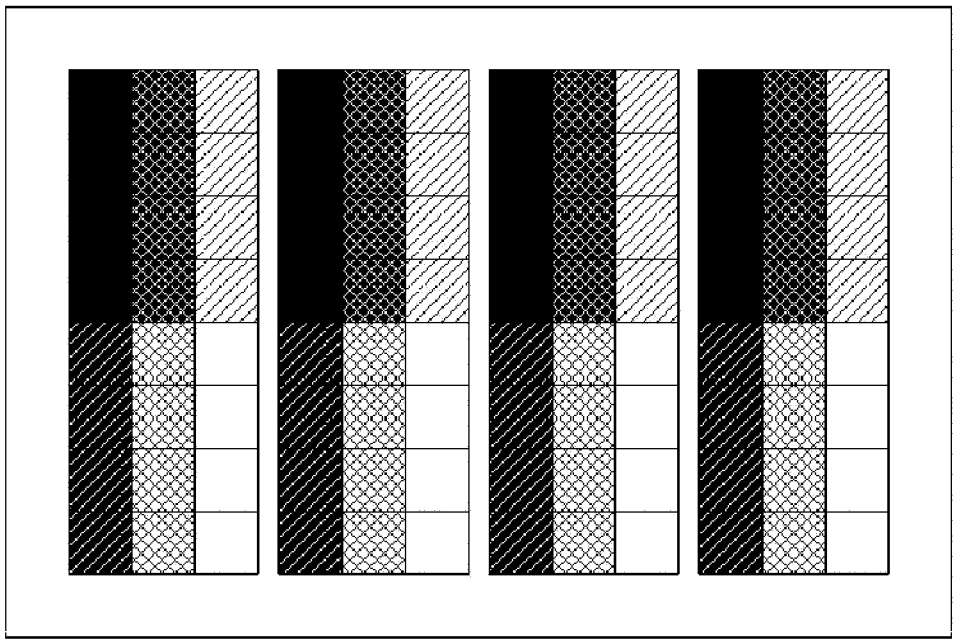
FIG. 12 is a diagram illustrating an example of a color chart for correction.

FIG. 12 is a diagram illustrating an example of the color chart for correction. This color chart is configured so that patches of the respective colors of Y, M, C and K are formed with 24 gradations on an A4-size sheet (210 mm×297 mm), for example. That is, the number of patches of each color in this color chart is larger than the number of patches of each color in the pattern for adjustment. In the color chart, in addition to the shown patches, an image for determining the direction of the sheet, or the like may be formed.

The image forming apparatus 100 reads such a color chart using the image reading section 130 (step Sc4), and determines whether the position and direction of the sheet are appropriate (step Sc5). When it is determined that the position of the sheet is deviated or that the reading is not performed in a predetermined direction, for example, the image forming apparatus 100 displays a message in the UI section 140 to request the user to cause the color chart to be read again (step Sc6).

After the reading of the color chart is appropriately performed, the image forming apparatus 100 detects the density of each patch (step Sc7), and changes the image forming condition based on the density difference between the detected density and the object density (step Sc8). In the present example, the image forming apparatus 100 changes the look up table to change the image forming condition (this does not prevent the change of a different image forming condition).

After the image forming condition is changed, the image forming apparatus 100 determines whether to perform the correction for the other screens (step Sc9). When any screen that is the correction object is remained, the image forming apparatus 100 executes the processes of step Sb1 and the subsequent steps for the screen. When any screen that is the correction object is not remained, the image forming apparatus 100 finishes the gradation correction.

FIG. 13 is a diagram illustrating an example of storage information stored by the gradation correction. The storage information shown in FIG. 13 further includes density differences (chart density differences in the figure) obtained by reading the respective patches (4 colors×24) of the color chart for correction and corresponding values ("LUT (0)" to "LUT (255)" in the figure) of the look up table, which is different from the storage information in the simple gradation correction shown in FIG. 9. In the other points, the two types of storage information are the same. The density differences obtained by reading the color chart correspond to an example of the first information according to the exemplary embodiment of the invention, and the values of the look up table generated corresponding thereto correspond to an example of the second information according to the exemplary embodiment of the invention.

Similarly to the case of the simple gradation correction, in the gradation correction, the image forming apparatus 100 may record or transmit the charging output, the exposure output, the bias output and the like before and after the correction of the image forming condition, or may display some or all of the storage information in the UI section 140. Further, in the present example, an example in which the values of the look up table are divided into the values changed by the pattern for adjustment and the values changed by the color chart for correction is shown, but actually, these look up tables may be combined for storage.

FIG. 14 is a diagram illustrating an example of a screen displayed in the UI section 140 in the density adjustment. In the density adjustment, the image forming apparatus 100 receives an operation for a density change from a user, and changes the image forming condition (here, the look up table) so that an image is formed at a density according to the operation, without the necessity of forming the patches as in the cases of the simple gradation correction and the gradation correction.

In the screen shown in FIG. 14, a density region is divided into three regions of a "low density", a "medium density" and a "high density" for each color of yellow, magenta, cyan and black. In each density region, when the density is to be thicker than a reference density (0), a positive value is input by the user, and when the density is to be thinner than the reference density, a negative value is input by the user. For example, in the example shown in FIG. 14, yellow has a density thicker than the reference value only in the medium density region, whereas magenta has a density thinner than the reference value in all the density regions. The value that may be input by the user, that is, a density adjustment width is not particularly limited, but it is preferable that about three-stage values in each of the positive and negative values, that is, "−3", "−2", "−1", "0", "+1", "+2" and "+3" be set, for example.

FIG. 15 is a diagram illustrating an example of storage information stored by the density adjustment. The storage information shown in FIG. 15 includes values of the look up table before being adjusted and values of the look up table adjusted according to the operation of the user, which is different from the storage information in the simple gradation correction shown in FIG. 9. Here, the values of the look up table before being adjusted corresponds to an example of the first information according to the exemplary embodiment of the invention, and the values of the look up table generated according to the operation of the user corresponds to an example of the second information according to the exemplary embodiment of the invention. With respect to the values of the look up table before being adjusted, all the input values may be stored, or only the input values of any representative one among the low density region, the medium density region and the high density region may be stored. Further, the adjusted values of the look up table are values corresponding to the values input by the user in the screen shown in FIG. 14.

The image forming apparatus 100 may form patches onto the intermediate image transfer belt 124 (or a sheet) before and after execution of the density adjustment, may allow the density differences of the image forming condition before and after being changed to be included in the storage information, and thus, may cause the user to recognize the situations before and after execution of the density adjustment.

As described above, according to the present example, when the image forming condition is changed by the manual image quality adjustment, the information (first information and second information) indicating the image forming condition before and after being changed is stored in association. A serviceman or a manager confirms the information stored in association in this way to check the image forming condition before and after being changed (that is, the states or situations of the image forming apparatus 100).

Other Examples

The image forming apparatus 100 may control an execution condition or an execution timing of the automatic image quality adjustment according to the execution result of the manual image quality adjustment. For example, the image forming apparatus 100 may determine the execution timing of the automatic image quality adjustment based on the execution frequency of the manual image quality adjustment, or may reflect the image forming condition changed by the manual image quality adjustment into the automatic image quality adjustment.

Modification Examples

The above-described examples are only exemplary embodiments of the invention. The invention is not limited to the above-described examples, and for example, may include modification examples as described below. Further, the modification examples herein may be properly combined as necessary.

(1) The manual image quality adjustment does not have to be plural types, and at least one of the above-described three types has only to be executed. Further, when the manual image quality adjustments of plural types may be executed, the storage information may include information indicating the type of the executed manual image quality adjustment.

(2) In the above-described examples, the image quality approximately relates to color reproduction (density difference). However, the image quality may not be determined only by color, and for example, positional deviation or the like may also become a factor that affects the image quality. Accordingly, in the exemplary embodiment of the invention, the positional deviation instead of the density may be a correction (change) object, or both of the density and the positional deviation may be the correction object.

(3) The image forming apparatus according to the exemplary embodiment of the invention is not limited to the configuration shown in FIG. 3. For example, the image forming section 120 may be a so-called rotary development type, or may have toner colors other than four. Further, the image reading section 130 may be a contact image sensor (CIS) type, that is, a type in which a light source and an image sensor are integrated and the integrated member is in close contact with a sheet to read an image. Further, the image reading section 130 may not be provided, and a sensor that reads an image after being fixed may be provided instead of the image reading section 130.

Further, the image forming apparatus according to the exemplary embodiment of the invention is not limited to the electro-photographic type, and may employ a different recording type such as an injection type. Here, when the recording type is different, a specific image forming condition may be different.

(4) The exemplary embodiment of the invention may be provided as a control device that is independent of the image forming apparatus, or may be provided as a program that causes a computer to function as the control device according to the exemplary embodiment of the invention. Further, the program according to the exemplary embodiment of the invention may be provided in a state of being stored in a computer readable recording medium such as a magnetic recording medium (a magnetic tape, a magnetic disc or the like), an optical recording medium (an optical disc or the like), an optical magnetic recording medium or a semiconductor memory. Further, such a program may be downloaded to the control device or the image forming apparatus through a communication unit such as the Internet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A control device comprising:

a reception unit that receives an instruction of an image quality adjustment from a user;

a changing unit that changes, when the instruction is received by the reception unit, an image forming condition in an image forming section from a first condition to a second condition;

an output unit that outputs first information indicating the first condition and second information indicating the second condition in association; and a recording unit that records in association the first information and the second information respectively indicating the image forming condition before and after being changed every time when the instruction is received by the reception unit and the image forming condition is changed by the changing unit, wherein the output unit outputs a plurality of pairs of the first information and the second information, corresponding to plural times of changes by the changing unit, recorded by the recording unit at a predetermined timing or according to a request from the outside, and wherein the recording unit keeps the recorded plurality of pairs of the first information and the second information until being output by the output unit.

2. The control device according to claim 1, wherein the recording unit records in association, when an external apparatus is not connected, the first information and the second information respectively indicating the image forming condition before and after being changed every time when the instruction is received by the reception unit and the image forming condition is changed by the changing unit, and wherein the output unit outputs the plurality of pairs of the first information and the second information recorded by the recording unit when the external apparatus is connected.

3. The control device according to claim 1, wherein the control device is connect to an image forming apparatus, wherein an external apparatus connected to the image forming apparatus comprises a display apparatus, and a plurality of pairs of the first information and the second information is displayed by the display apparatus.

4. The control device according to claim 1, wherein the first information relates to the density of an image for a gradation correction.

5. The control device according to claim 1, wherein the second information indicates an output gradation value changed by the changing unit, corresponding to an input gradation value.

6. An image forming apparatus comprising:

the control device according to claim 1; and an image forming section that forms an image according to the image forming condition controlled by the control device.

7. A non-transitory computer readable medium storing a program that causes a computer to execute a process, the process comprising:

receiving an instruction of an image quality adjustment from a user;

changing, when the instruction is received, an image forming condition in an image forming section from a first condition to a second condition;

outputting first information indicating the first condition and second information indicating the second condition in association, and recording in association the first information and the second information respectively indicating the image forming condition before and after being changed every time when the instruction is received by the reception unit and the image forming condition is changed by the changing unit, wherein the outputting comprises outputs a plurality of pairs of the first information and the second information, corresponding to plural times of changes by the changing unit, recorded by the recording unit at a predetermined timing or according to a request from the outside, and wherein the recording comprises keeping the recorded plurality of pairs of the first information and the second information until being output by the output unit.

8. A control method comprising:

receiving an instruction of an image quality adjustment from a user;

changing, when the instruction is received, an image forming condition in an image forming section from a first condition to a second condition;

outputting first information indicating the first condition and second information indicating the second condition in association, and recording in association the first information and the second information respectively indicating the image forming condition before and after being changed every time when the instruction is received by the reception unit and the image forming condition is changed by the changing unit, wherein the outputting comprises outputs a plurality of pairs of the first information and the second information, corresponding to plural times of changes by the changing unit, recorded by the recording unit at a predetermined timing or according to a request from the outside, and wherein the recording comprises keeping the recorded plurality of pairs of the first information and the second information until being output by the output unit.

* * * * *